US005258588A

United States Patent [19]

Micheletti et al.

[11] Patent Number: 5,258,588

[45] Date of Patent: Nov. 2, 1993

[54] PUFFER TYPE SWITCH HIGH CURRENT ELECTRICAL SWITCH CONTACT ASSEMBLY

[75] Inventors: Raymond E. Micheletti, Hudson, Ohio; William R. Rueth, Mokena; Samual Duvall, Hinsdale, both of Ill.

[73] Assignee: Joslyn Corporation, Chicago, Ill.

[21] Appl. No.: 883,663

[22] Filed: May 15, 1992

[51] Int. Cl.[5] ..... H01H 33/88; H01H 1/02

[52] U.S. Cl. ..... 200/148 A

[58] Field of Search ..... 200/148 A, 148 R, 148 BV, 200/150 G, 148 B

[56] References Cited

U.S. PATENT DOCUMENTS

| | | | |
|---|---|---|---|
| 3,947,650 | 3/1976 | Strain et al. | 200/148 B |
| 4,736,079 | 4/1988 | Soboul et al. | 200/148 A |
| 4,851,622 | 7/1989 | Hosomi et al. | 200/148 A |
| 4,910,367 | 3/1990 | Akers et al. | 200/148 A |

*Primary Examiner*—J. R. Scott

*Attorney, Agent, or Firm*—Marshall, O'Toole, Gerstein, Murray & Borun

[57] ABSTRACT

The electrical switch according to the present invention has first and second electrical contacts each of which functions as both male and female contacts. More specifically, the first electrical contact includes a first electrical contact member having outer and inner perimeters. The second electrical contact includes a second electrical contact member also having outer and inner perimeters. A contact probe is secured to the second electrical contact member within the inner perimeter thereof. Thus, when the first electrical contact is in electrical contact with the second electrical contact, the inner perimeter of the second electrical contact member electrically contacts the outer perimeter of the first electrical contact member and the contact probe electrically contacts the inner perimeter of the first electrical contact member.

25 Claims, 7 Drawing Sheets

PUFFER TYPE SWITCH HIGH CURRENT ELECTRICAL SWITCH CONTACT ASSEMBLY

TECHNICAL FIELD OF THE INVENTION

The present invention relates to an electrical switch having switch contacts which are configured to conduct a momentary fault current of 40,000 amperes.

BACKGROUND OF THE INVENTION

Electrical switches are used in a variety of applications to control current flow between two points of an electrical circuit. One common application of electrical switches is to control current flow in a power distribution system where the electrical switches are frequently used to isolate various electrical equipment in the power distribution system so that such equipment can be repaired.

Current flow through the electrical switches of a power distribution system is normally on the order of 200–600 amperes. However, large fault currents, such as may be produced by a short circuit condition, occasionally flow in the power distribution system. These fault currents are usually momentary because normally a circuit breaker or other fault sensing device responds to the fault condition by interrupting current flow in the power distribution system. The contacts of the electrical switches in the power distribution system must be able to withstand such momentary fault currents without experiencing substantial deterioration. Also, the contacts of these switches must be able to operate between open and closed states, without substantial adverse effects, while a fault current is flowing through the contacts of the switches. That is, these contacts must retain their integrity when they are closed into a large momentary fault current. Prior switch contacts have been capable of carrying momentary fault currents up to 32,000 amperes. The contacts of the present invention are capable of carrying momentary fault currents of 40,000 amperes.

SUMMARY OF THE INVENTION

The electrical switch according to the present invention has first and second electrical contacts each of which functions as both male and female contacts.

More specifically, the first electrical contact includes a first electrical contact member having an outer perimeter, an inner perimeter, and a recess. The second electrical contact includes a second electrical contact member also having an outer perimeter, an inner perimeter, and a recess. A contact probe is secured to the second electrical contact member within the recess thereof. The first and second electrical contact members and the contact probe are arranged so that, when the first electrical contact is in electrical contact with the second electrical contact, (a) the first electrical contact member is received within the recess of the second electrical contact member whereby the inner perimeter of the second electrical contact member electrically contacts the outer perimeter of the first electrical contact member and (b) the contact probe is received within the recess of the first electrical contact member whereby the contact probe electrically contacts the inner perimeter of the first electrical contact member.

The first electrical contact member may be slotted so that the first electrical contact member is provided with flexible contact fingers. Likewise, the second electrical contact member may be slotted so that the second electrical contact member is provided with flexible contact fingers.

The contact probe may have a tip which enters the recess of the first electrical contact member as the first and second electrical contacts are closed. A spring member may be provided on the second electrical contact member so as to dampen bouncing and increase contact pressure of the flexible contact fingers of the second electrical contact member when the first electrical contact member is received within the recess of the second electrical contact member.

The first and second electrical contact members may be supported within a housing. The housing may be provided with a valve which is arranged to selectively interconnect a volume outside of the housing to a volume within the housing between the housing and the second electrical contact. The housing may also be provided with a vent through the housing between the first and second electrical contacts.

The electrical switch may further include a puffer to enclose an end of the second electrical contact so that, as the second electrical contact is moved toward the first electrical contact during switch closure, any gas in the housing is compressed around the first electrical contact and so that, as the second electrical contact is withdrawn from the first electrical contact during switch opening, any gas in the housing is forced toward the first electrical contact. The gas within the housing may be selected so as to minimize any arcing between the first and second electrical contacts as the electrical switch is opened and closed.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
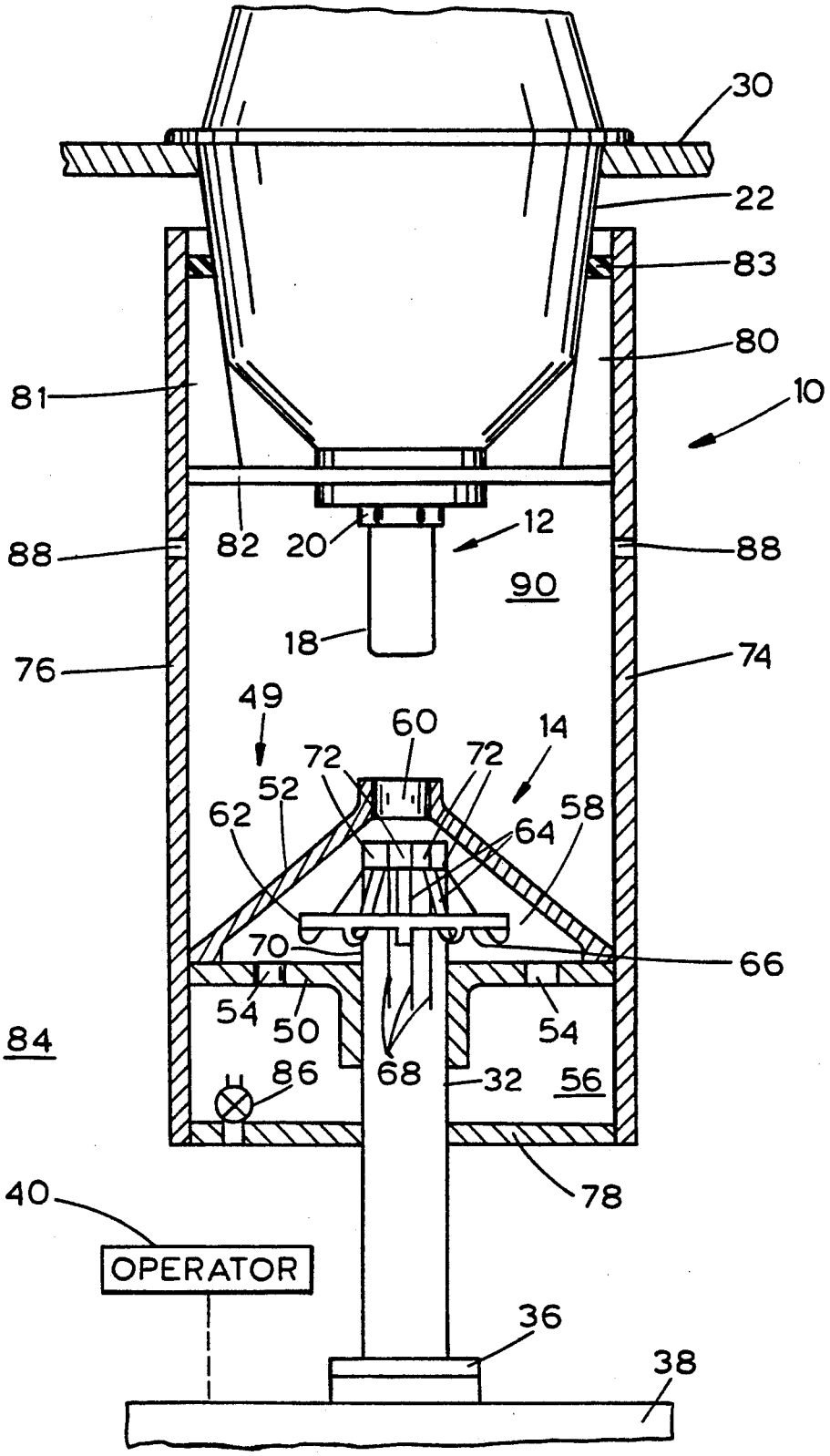
FIGURE 1 PRIOR ART
FIG. 1 is a partial cross-sectional view of a prior art electrical switch capable of carrying momentary fault currents up to 32,000 amperes.
Figure 2:
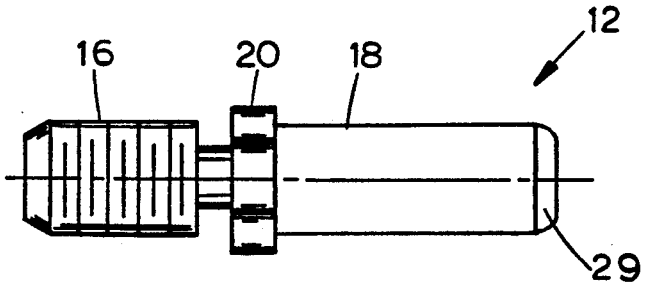
FIGURE 2 PRIOR ART
FIG. 2 is a side view of a first electrical contact of the electrical switch shown in FIG. 1.

Shown in FIG. 1 is an electrical switch 10 which is used in the SF6 Load Break Switch manufactured and sold by Joslyn Power Products Corporation. The electrical switch 10 has a first switch contact 12 and a second switch contact 14. The first switch contact 12 is shown in more detail in FIGS. 2 and 3. This first switch contact 12 has a threaded end 16 and a contact end 18 separated by a flange 20. The flange 20 has a plurality of facets to accommodate a wrench which may be used to threadably and electrically secure the first electrical contact 12 to a bushing 22 (shown in FIG. 1).

Figure 3:
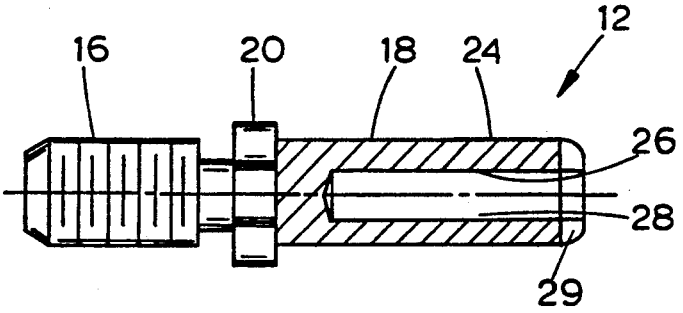
FIGURE 3 PRIOR ART
FIG. 3 is a partial cross-sectional view of the first electrical contact shown in FIG. 2.

As shown in FIG. 3, the contact end 18 of the first electrical contact 12 has an outer perimeter 24 and an inner perimeter 26. The inner perimeter 26 defines a recess 28 within the contact end 18 of the first electrical contact 12. The first electrical contact 12 has a copper tungsten tip 29. Copper tungsten has a high melting temperature such that the tip 29 resists erosion due to arcing.

As shown in FIG. 1, the threaded end 16 of the first electrical contact 12 threadably engages the bushing 22 which is supported by a wall 30. The wall 30 is only partially shown in FIG. 1 and is part of the SF6 housing (the remaining SF6 housing is not shown). This SF6 housing encloses one or more electrical switches, such as the electrical switch 10. The electrical switch 10 controls current flow through an electrical line such as may be used in a power distribution system. The SF6 housing is sealed and contains an arc extinguishing gas such as sulfur hexafluoride gas.

When the first electrical contact 12 is threadably engaged to the bushing 22, the threaded end 16 of the first electrical contact 12 electrically engages a current carrying member (not shown) which runs through the bushing 12 to a point outside of the SF6 housing so that an electrical line (e.g. of a power distribution system) can be electrically connected to the bushing 22 and, thereby, to the first electrical contact 12.

Figure 4:
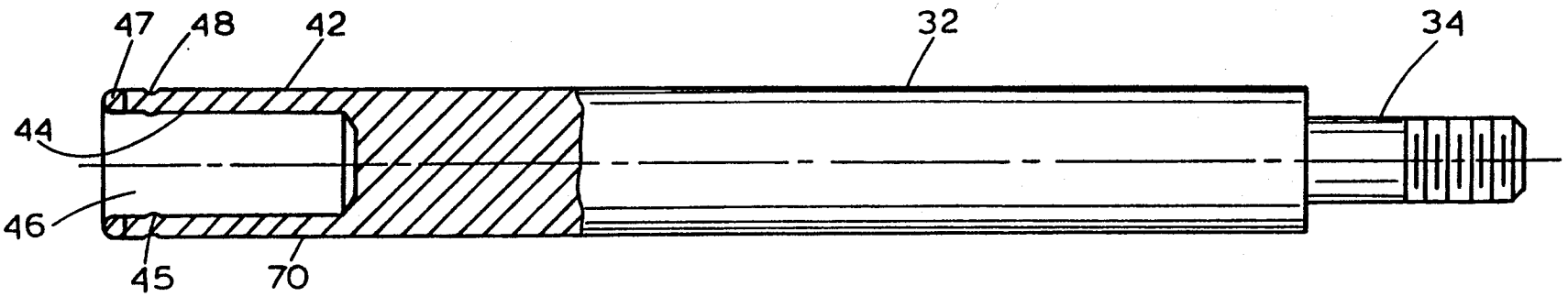
FIGURE 4 PRIOR ART
FIG. 4 is a partial cross-sectional view of a second electrical contact of the electrical switch shown in FIG. 1.

The second electrical contact 14 of the switch 10 includes a current carrying rod 32 which is shown in more detail in FIG. 4. The current carrying rod 32 has a threaded end 34 to threadably engage a flexible conductor 36 and an operating bar 38 (as shown in FIG. 1) of the SF6 Load Break Switch. An operator 40, such as a spring operated mechanism, may be provided for actuating the operating bar 38 to drive the second electrical contact 14 toward and away from the first electrical contact 12.

As shown in FIG. 4, the rod 32 has an outer perimeter 42 and an inner perimeter 44. A raised land 45 may circumscribe the inner perimeter of the rod 32 to act as a contact surface for electrically engaging the outer perimeter 24 of the first contact 12 when the switch 10 is closed. The inner perimeter 44 forms a recess 46. The rod 32 has a copper tungsten tip 47; thus, the tip 47 resists erosion due to arcing. A depression 48 is formed in the rod 32 around its outer perimeter 42.

Figure 10:
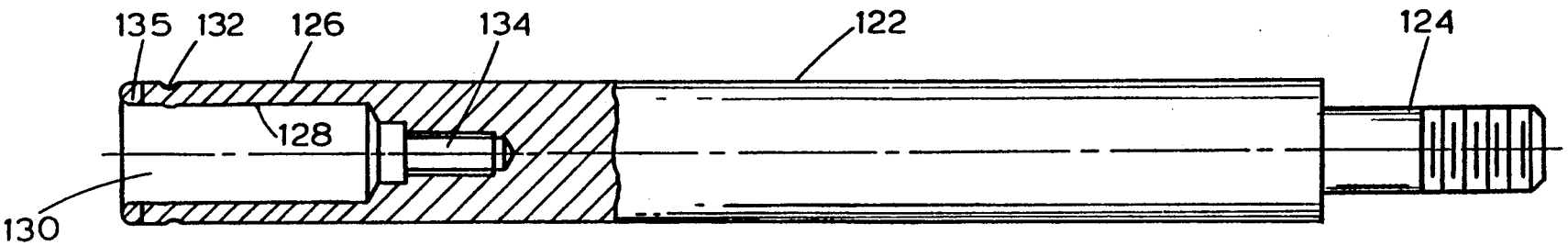
FIG. 10 is a partial cross-sectional view of an electrical contact member of the second electrical contact shown in FIG. 9.

As shown in FIG. 1, a puffer 49 includes an orifice plate 50 and a puffer cone 52 (also shown in FIG. 10). The orifice plate 50 is attached to the current carrying rod 32 by, for example, a hose clamp (not shown in FIG. 1) and has a plurality of orifices 54 therethrough for providing communication between a volume 56 and a puffer volume 58. The puffer cone 52 is attached to the orifice plate 50 by screws, for example, and has an open end 60. The opening of the open end 60 is large enough to accommodate the outer perimeter 24 of the contact end 18 of the first electrical contact 12. The current carrying rod 32 carries a contact spring 62. The contact spring 62 has a plurality of leaf springs 64 extending from a cylindrical tube 66 to the depression 48 around the outer perimeter 42 of the current carrying rod 32. The current carrying rod 32 has a plurality of slots 68 therein extending along a contact end 70 thereof. The slots 68 extend from the outer perimeter 42 to the inner perimeter 44 of the current carrying rod 32. Accordingly, the slots 68 form a plurality of flexible contact fingers 72 in the contact end 70 of the current carrying rod 32. The spring member 62 with its depending leaf springs 64 dampen bouncing and increase contact pressure of the flexible contact fingers 62 as the second electrical contact 14 engages the first electrical contact 12.

The first and second electrical contacts 12 and 14 are contained within a switch housing 74 having a cylindrical wall 76 and an end wall 78. The current carrying rod 32 of the second electrical contact 14 extends through the end wall 78 of the housing 74. A cup 80, having a cylindrical wall 81 and an end wall 82, is attached to the housing 74 by, for example, rivets (not shown). When the first electrical contact 12 threadably engages the bushing 22, the bushing 22 is clamped to the end wall 82 of the cup 80 thus attaching the housing 74 to the bushing 22. Since the bushing 22 is secured to the SF6 housing, the housing 74 is also secured to the SF6 housing. An O-ring 83 is provided to allow proper alignment between the housing 74 and the bushing 22 as the switch 10 is operated by the operating bar 38.

As previously mentioned, the SF6 housing contains sulfur hexafluoride gas. This gas is non-flammable, non-toxic, colorless and odorless, and has good insulating and arc extinguishing properties. The sulfur hexafluoride gas in the SF6 housing extinguishes any arcing between the first and second electrical contacts 12 and 14 of the electrical switch 10. A check valve 86 is provided for permitting one way flow of the sulfur hexafluoride gas from a volume 84 of the SF6 housing to the volume 56 within the housing 74. The volume 56 is between the end plate 78 and the oriface plate 50 of the second electrical contact 14. The housing 74 of the electrical switch 10 also has vents 88 located between the first and second electrical contacts 12 and 14.

As the operating bar 38 drives the second electrical contact 14 toward the first electrical contact 12 to close the electrical switch 10, the puffer cone 52 compresses the sulfur hexafluoride gas in the volume 90 between the first and second electrical contacts 12 and 14. The sulfur hexafluoride gas surrounding the first and second electrical contacts 12 and 14 minimizes any arcing between these contacts. The compression of the sulfur hexafluoride gas enhances its insulating and arc extinguishing properties. At the same time, the check valve 86 allows the sulfur hexaflouriode gas in the volume 84 to flow into the expanding volume 56, and the vents 88 through the housing 74 limit the pressure of the sulfur hexafluoride gas in the volume 90. Thus, the vents 88 permit the excess pressure in the volume 90 to be leaked from the housing 74 to the volume 84.

As the second electrical contact 14 approaches the first electrical contact 12, the contact end 18 of the first electrical contact 12 enters the recess 46 of the current carrying rod 32. Since the outer perimeter 24 of the contact end 18 is substantially commensurate with the inner perimeter 44 of the current carrying rod 32, the contact end 18 of the first electrical contact 12 electrically engages the current carrying rod 32 as the contact end 18 of the first electrical contact 12 enters the recess 46. Motion of the second electrical contact 14 ceases when the contact end 18 of the first electrical contact 12 fully enters the recess 46 of the current carrying rod 32. The leaf springs 64 of the contact spring 62 exert a resilient pressure on the contact fingers 72 of the current carrying rod 32 in order to dampen bouncing and increase contact pressure of the contact fingers 72 as the first and second electrical contacts 12 and 14 engage. The operator 40 and the operating bar 38 may be arranged to drive the first and second electrical contacts 12 and 14 together rapidly in order minimize the time during which arcing can occur therebetween.

When the switch 10 is opened, the operator 40 and the operating bar 38 move the second electrical contact 14 away from the first electrical contact 12. As the second electrical contact 14 is withdrawn from the first electrical contact 12, the pressure of the sulfur hexafluoride gas within the volume 56 and within the puffer volume 58 increases. The check valve 86 closes to prevent gas leaking from the volume 56 back to the volume 84 through the valve 86. Consequently, gas is forced from the volume 56, through the orifices 54 in the orifice plate 50, into the puffer volume 58, and out through the open end 60 of the puffer cone 52. This gas is directed to the volume 90 surrounding the first electrical contact 12 to extinguish arcing between the first and second electrical contacts 12 and 14 as they separate.

The electrical switch 10 shown in FIGS. 1–4 is capable of carrying a momentary 32,000 ampere fault current. However, the switch 100 as shown in FIGS. 5–13 is arranged to withstand momentary fault currents of 40,000 amperes. Many of the elements of the switch 100 are similar to the elements of the switch 10; therefore, like reference numerals are used to depict like elements. Unlike the electrical switch contacts 12 and 14 of the switch 10, however, the electrical contacts 102 and 104 of the switch 100 are arranged to withstand momentary fault currents of 40,000 amperes.

Figure 6:
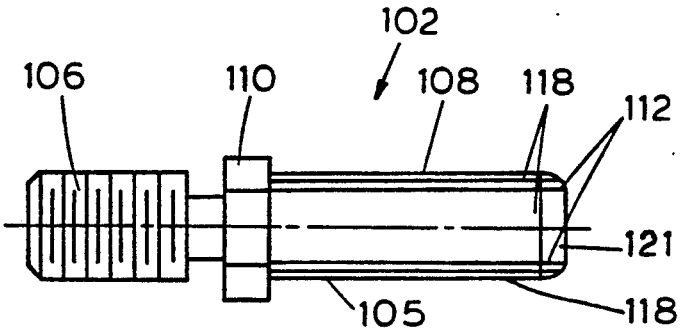
FIG. 6 is a side view of a first electrical contact of the electrical switch shown in FIG. 5.
Figure 7:
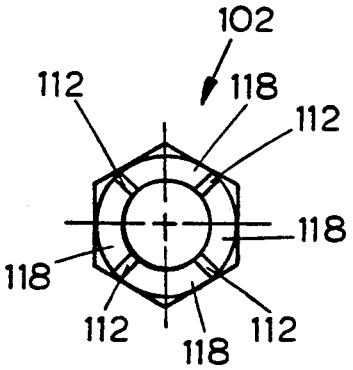
FIG. 7 is an end view of the first electrical contact shown in FIG. 6.
Figure 8:
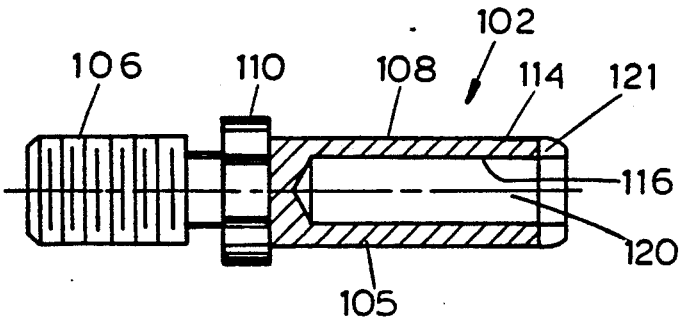
FIG. 8 is a partial cross-sectional view of the first electrical contact shown in FIG. 6.

The first electrical contact 102 of the electrical switch 100 is shown in more detail in FIGS. 6–8. The first electrical contact 102 has a threaded end 106 for threadably engaging the bushing 22. The first electrical contact 102 also has a first electrical contact member 108 and a flange 110 which separates the threaded end 106 and the first electrical contact member 108 and which is arranged so that a tool can be used to threadably engage the first electrical contact 102 to the bushing 22. The threaded end 106, the first electrical member 108, and the flange 110 may be of unitary construction to form the first electrical contact 102.

As shown in FIGS. 6 and 7, a plurality of slots 112 are provided in the first electrical contact member 108 extending from an outer perimeter 114 to an inner perimeter 116 thereof. Thus, these slots 112 form a plurality of flexible contact fingers 118 in the first electrical contact member 108. As shown in FIG. 8, the inner perimeter 116 forms a recess 120 within the first electrical contact member 108. The first electrical contact member 108 has a copper tungsten tip 121. The tip 121, therefore, resists erosion due to arcing.

Figure 5:
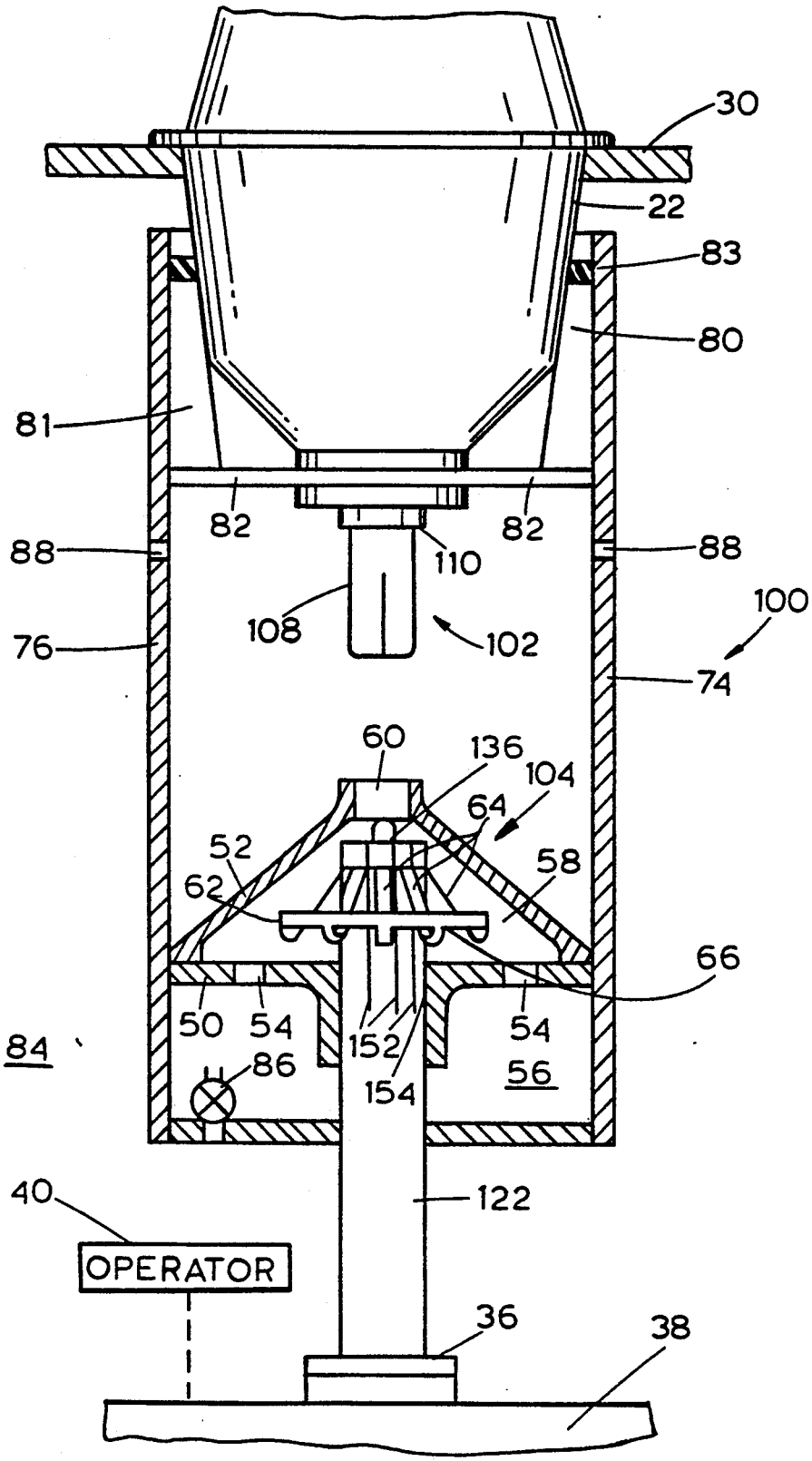
FIG. 5 is a partial cross-sectional view of an electrical switch according to the present invention.
Figure 9:
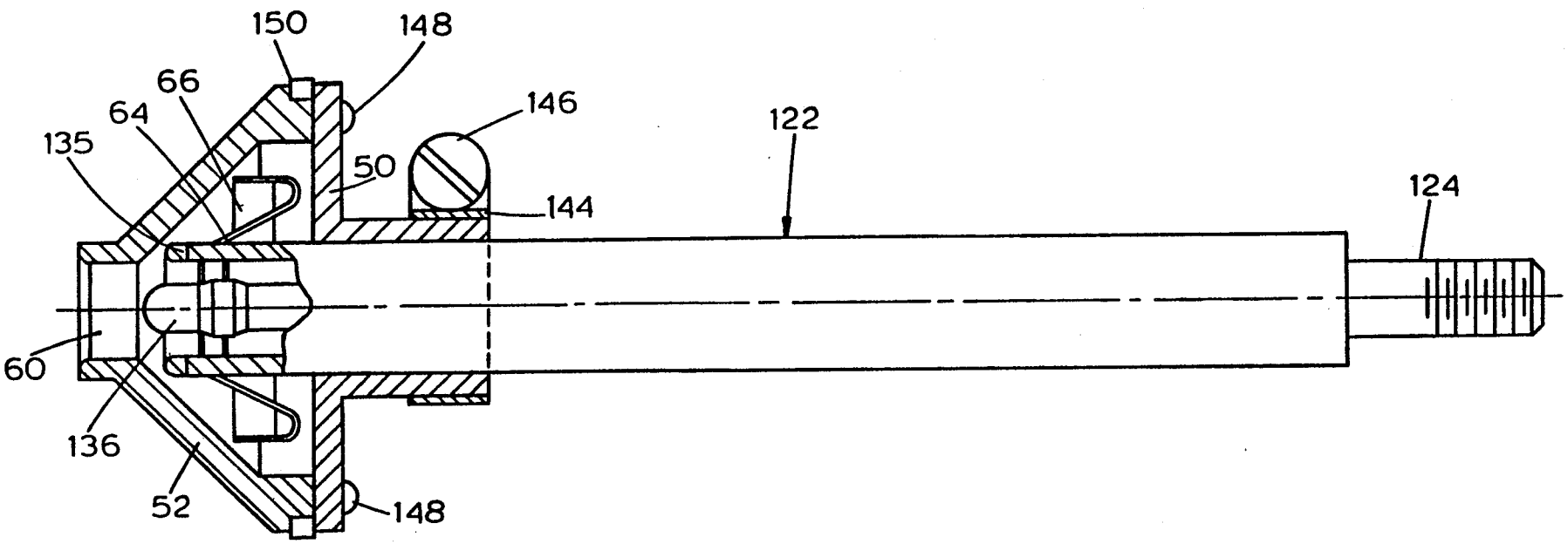
FIG. 9 shows the construction of the second electrical contact of the electrical switch shown in FIG. 5.

The second electrical contact 104 of the electrical switch 100 is shown in more detail in FIGS. 9–13. This second electrical contact 104 has a second electrical contact member 122 which has a threaded end 124 for engaging the flexible conductor 36 and the operating bar 38 shown in FIG. 5. As shown in FIG. 10, the second electrical contact member 122 has an outer perimeter 126 and an inner perimeter 128. The inner perimeter 128 forms a recess 130. A depression 132 extends around the outer perimeter 126 of the second electrical contact member 122. As shown in FIGS. 5 and 9, the depression 132 around the outer perimeter 128 of the second electrical contact member 122 receives the leaf springs 64 of the spring member 62. As shown in FIG. 10, the second electrical contact member 122 has an internally threaded portion 134. The inner perimeter 128 of the second electrical contact member 122 may have a raised land, similar to the raised land 45 circumscribing the inner perimeter of the rod 32, to act as a contact surface for electrically engaging the outer perimeter 114 of the first electrical contact member 108 when the switch 100 is closed. The second electrical contact member 122 has a copper tungsten tip 135. The tip 135, thus, resists erosion due to arcing.

Figure 11:
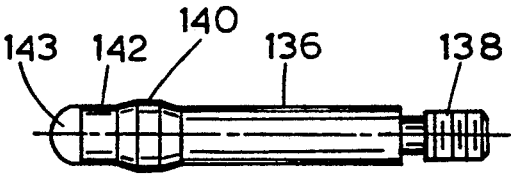
FIG. 11 is a side view of a contact probe used in the second electrical contact shown in FIG. 9.
Figure 12:
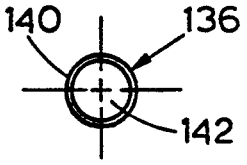
FIG. 12 is an end view of the contact probe shown in FIG. 11.

A contact probe 136 is shown in more detail in FIGS. 11 and 12. The contact probe 136 has a threaded end 138 which threadably engages the internally threaded portion 134 of the second electrical contact member 122. The contact probe 136 has a probe perimeter 140 over at least a portion thereof. The contact probe 136 also has a contact probe tip 142 which has a perimeter somewhat smaller than the contact probe perimeter 140. A portion 143 of the tip 142 is provided with copper tungsten so that the portion 143 of the tip 135 resists erosion due to arcing.

Figure 13:
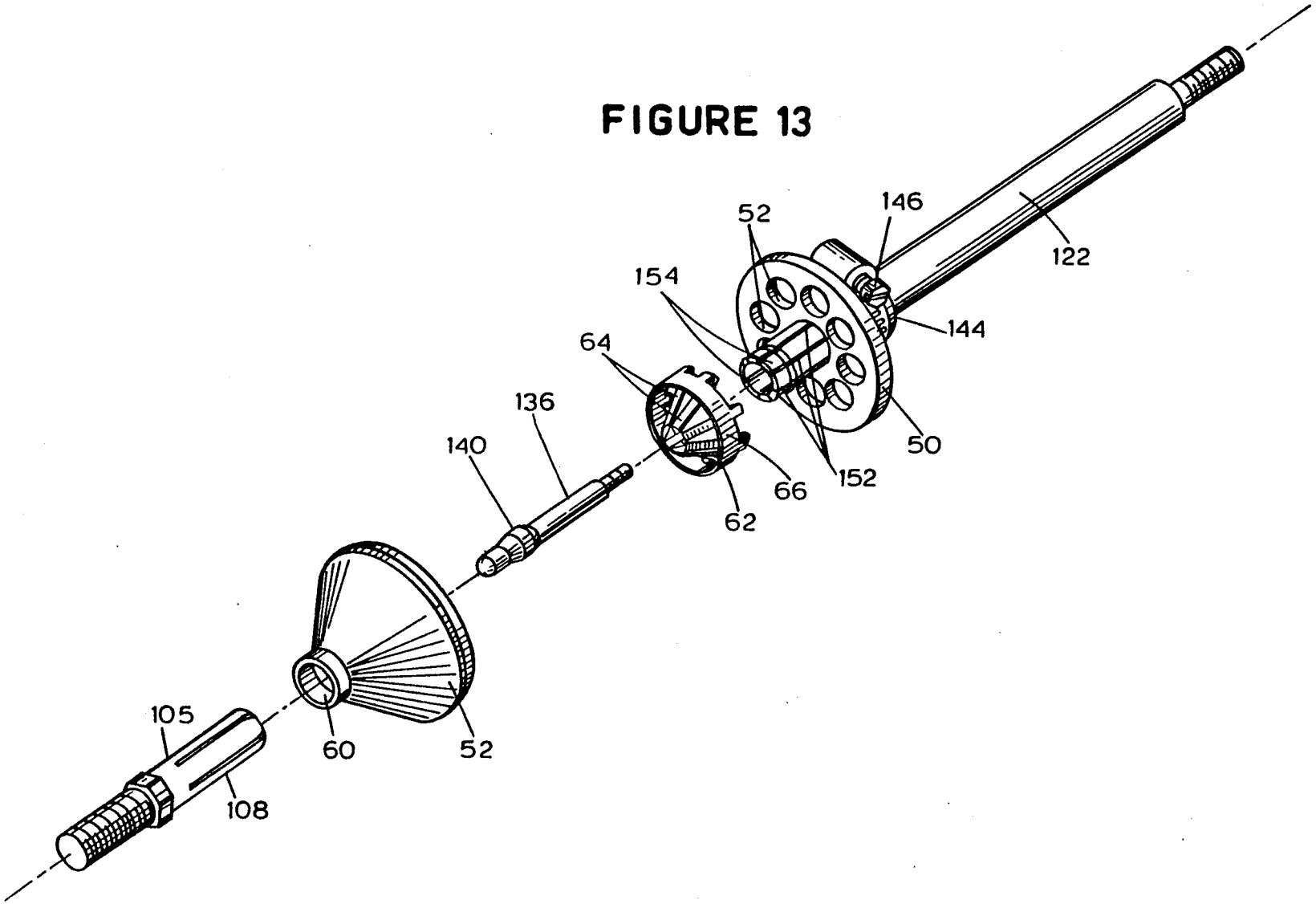
FIG. 13 is an exploded view of the first and second electrical contacts of the electrical switch shown in FIG. 5.

As shown in FIGS. 9 and 13, the orifice plate 50 is attached to the second electrical contact member 122 by a hose clamp 144 which has a screw 146 for tightening the hose clamp 144 and, therefore, the orifice plate 50 onto the second electrical contact member 122. As shown in FIG. 9, the puffer cone 52 is attached to the orifice plate 50 by screws 148. A piston ring 150 may be provided as a seal between the puffer cone 52 and the orifice plate 50. As shown in FIGS. 5 and 13, the second electrical contact member 122 is provided with a plurality of slots 152 which form flexible contact fingers 154 in the second electrical contact member 122.

The probe perimeter 140 of the contact probe 136 is substantially commensurate with the inner perimeter 116 of the first electrical contact member 108 and the inner perimeter 128 of the second electrical contact member 122 is substantially commensurate with the outer perimeter 114 of the first electrical contact member 108. Thus, as the switch 100 is closed, the flexible contact fingers 118 of the first electrical contact member 108 enter the recess 130 of the second electrical contact member 122 between the flexible contact fingers 154 and the contact probe 136, and the contact probe 136 enters the recess 120 of the first electrical contact member 108. Since the outer perimeter 114 of the first electrical contact member 108 is substantially commensurate with the inner perimeter 128 of the second electrical contact member 122, the outer perimeter 114 of the first electrical contact member 108 electrically engages the inner perimeter 128 of the second electrical contact member 122. Also, since the probe perimeter 140 of the contact probe 136 is substantially commensurate with the inner perimeter 116 of the first electrical contact member 108, the probe perimeter 140 of the contact probe 136 electrically engages the inner perimeter 116 of the first electrical contact member 108. Also, as the switch 100 is opened and closed, the flow of sulfur hexafluoride gas in the switch 100 is the same as it is in the switch 10.

The contact probe 136 of the second electrical contact 104 increases the surface area through which current conducts between the first and second electrical contacts 102 and 104. This increased surface area allows a larger momentary fault current to conduct between the first and second electrical contacts 102 and 104 than between the first and second contacts 12 and 14. The flexible contact fingers 118 provided in the first electrical contact member 108 by the slots 112 insure good electrical contact between the first electrical contact member 108 and both the contact probe 136 and the second electrical contact member 122. The tip 142 of the contact probe 136 draws any arcing away from the probe perimeter 140 so that pitting of the contact area of the contact probe 136 (i.e. probe perimeter 140) is minimized. Thus, any pitting caused by arcing is substantially limited to the tip 142 and does not affect the electrical connection between the contact probe 136 and the first electrical contact member 108. Furthermore, the contact probe 136 not only increases the surface area through which current flows between the first and second electrical contacts 102 and 104, but it also shares in any arcing between the first and second electrical contacts 102 and 104; therefore, instead of all the arcing occurring between the first and second electrical contacts members 108 and 122, some of the arcing occurs between the first electrical contact member 108 and the contact probe 136. Accordingly, the switch 100 is capable of withstanding momentary fault currents of 40,000 amperes without any substantial deterioration of the operating characteristics of the electrical switch 100.

As can be seen from FIGS. 6–13, each of the first and second electrical contacts 102 and 104 has male and female contact properties. That is, the contact fingers 118 of the first electrical contact member 108 act as male contact members when they enter the recess 130 of the second electrical contact member 122, and the recess 120 of the first electrical contact member 108 acts as a female contact member for receiving the contact probe 136 of the second electrical contact 104. Similarly, the recess 130 of the second electrical contact member 122 acts as a female contact member for receiving the fingers 118 of the first electrical contact member 108, and the contact probe 136 of the second electrical contact 104 acts as a male contact member which is received by the recess 120 of the first electrical contact member 108.

Although the switch 100 according to the present invention has been described in context of an SF6 Load Break Switch, it should be recognized that the principles of the present invention can be used in conjunction with other types of electrical switches. However, the present invention is particularly suited for conducting large momentary fault currents. It should also be recognized that certain modifications can be made of the switch 100 without departing from the scope of the present invention. For example, the contact spring 62 is shown of unitary construction. However, the contact spring 62 can be comprised of a spring tube to which a plurality of leaf springs may be attached by screws, rivets or other suitable means.

We claim:

1. An electrical switch comprising:

a first electrical contact including a first electrical contact member having an outer perimeter, an inner perimeter, and a recess;

a second electrical contact including a second electrical contact member having an outer perimeter, an inner perimeter, and a recess, said second electrical contact further including a contact probe secured to the second electrical contact member within the recess of the second electrical contact member, the contact probe having a probe perimeter; and, wherein the first and second electrical contact members and the contact probe are arranged so that, when the first electrical contact is in electrical contact with the second electrical contact, the first electrical contact member is received within the recess of the second electrical contact member and the contact probe is received within the recess of the first electrical contact member whereby at least a portion of the inner perimeter of the second electrical contact member electrically contacts at least a portion of the outer perimeter of the first electrical contact member and whereby the probe perimeter of the contact probe electrically contacts at least a portion of the inner perimeter of the first electrical contact member.

2. The electrical switch of claim 1 wherein the first electrical contact member is slotted to provide at least two flexible contact fingers.

3. The electrical switch of claim 2 wherein the second electrical contact member is slotted to provide at least two flexible contact fingers.

4. The electrical switch of claim 3 wherein the contact probe comprises at least a tip and a probe contact surface, wherein the probe contact surface has a probe contact perimeter which is substantially equal to the probe perimeter and which is substantially commensurate with the inner perimeter of the first electrical contact member, wherein the tip of the contact probe has a tip perimeter which is smaller than the probe contact perimeter, and wherein the contact probe is arranged so that, when the first electrical contact member is received within the recess of the second electrical contact member to establish electrical contact between the first and second electrical contacts, the tip of the contact probe enters the recess of the first electrical contact member before the probe contact surface makes electrical contact with the inner perimeter of the first electrical contact member.

5. The electrical switch of claim 4 further comprising a spring member attached to the second electrical contact member and arranged to dampen bouncing and increase contact pressure of the at least two flexible contact fingers of the second electrical contact member.

6. The electrical switch of claim 1 wherein the second electrical contact member is slotted to provide at least two flexible contact fingers.

7. The electrical switch of claim 6 further comprising a spring member arranged to dampen bouncing and increase contact pressure of the at least two flexible contact fingers of the second electrical contact member.

8. The electrical switch of claim 1 wherein the contact probe comprises at least a tip and a probe contact surface, wherein the probe contact surface has a probe contact perimeter which is substantially equal to the probe perimeter and which is substantially commensurate with the inner perimeter of the first electrical contact member, wherein the tip of the contact probe has a tip perimeter which is smaller than the probe contact perimeter, and wherein the contact probe is arranged so that, when the first electrical contact member is received within the recess of the second electrical contact member to establish electrical contact between the first and second electrical contacts, the tip of the contact probe enters the recess of the first electrical contact member before the probe contact surface makes electrical contact with the inner perimeter of the first electrical contact member.

9. An electrical switch comprising:

a first electrical contact including a first electrical contact member having an outer perimeter, an inner perimeter, and a recess;

a second electrical contact including a second electrical contact member having an outer perimeter, an inner perimeter, and a recess, the second electrical contact further including a contact probe within the recess of the second electrical contact member wherein the contact probe has a probe perimeter;

the first and second electrical contacts members and the contact probe being arranged so that, when the first electrical contact is in electrical contact with the second electrical contact, the first electrical contact member is received within the recess of the second electrical contact member and the contact probe is received within the recess of the first electrical contact member whereby at least a portion of the inner perimeter of the second electrical contact member electrically contacts at least a portion of the outer perimeter of the first electrical contact member and whereby the probe perimeter of the contact probe electrically contacts at least a portion of the inner perimeter of the first electrical contact member;

a housing supporting said first and second electrical contacts so that at least one of the first and second electrical contacts is moveable therein;

a valve arranged to selectively interconnect a volume outside of the housing to a volume within the housing between the housing and the moveable one of the first and second electrical contacts; and, a vent through the housing between the first and second electrical contacts.

10. The electrical switch of claim 9 wherein the first electrical contact member is slotted to provide at least two flexible contact fingers.

11. The electrical switch of claim 10 wherein the second electrical contact member is slotted to provide at least two flexible contact fingers.

12. The electrical switch of claim 11 wherein the contact probe comprises at least a tip and a probe contact surface, wherein the probe contact surface has a probe contact perimeter which is substantially equal to the probe perimeter and which is substantially commensurate with the inner perimeter of the first electrical contact member, wherein the tip has a tip perimeter which is smaller than the probe contact perimeter, and wherein the contact probe is arranged so that, when the first electrical contact member is received within the recess of the second electrical contact member to establish electrical contact between the first and second electrical contacts, the tip of the contact probe enters the recess of the first electrical contact member before the probe contact surface makes electrical contact with the inner perimeter of the first electrical contact member.

13. The electrical switch of claim 12 further comprising a spring member attached to the second electrical contact member and arranged to dampen bouncing and increase contact pressure of the at least two flexible contact fingers of the second electrical contact member.

14. The electrical switch of claim 13 further comprising a puffer enclosing an end of the second electrical contact to thereby enclose an end of the second electrical contact member and an end of the contact probe within a puffer volume, the puffer being arranged (a) to compress any gas in the housing around the first electrical contact as the first and second electrical contacts electrically engage one another and (b) to force any gas in the housing toward the first electrical contact as the first and the second electrical contacts are electrically disengaged from one another.

15. The electrical switch of claim 14 wherein the puffer comprises an orifice plate around the second electrical contact member near the end of the second electrical contact member and a puffer cone attached to the orifice plate, the orifice plate and the puffer cone forming the puffer volume, the orifice plate having orifices therein to allow communication between the housing and the puffer volume, and the puffer cone having an opening (a) to allow electrical connection between the first and second electrical contacts and (b) to allow gas in the housing and in the puffer volume to be forced toward the first electrical contact as the first and the second electrical contacts are electrically disengaged from one another.

16. The electrical switch of claim 9 wherein the second electrical contact member is slotted to provide at least two flexible contact fingers.

17. The electrical switch of claim 16 further comprising a spring member attached to the second electrical contact member and arranged to dampen bouncing and increase contact pressure of the at least two flexible contact fingers of the second electrical contact member.

18. The electrical switch of claim 9 wherein the contact probe comprises at least a tip and a probe contact surface, wherein the probe contact surface has a probe contact perimeter which is substantially equal to the probe perimeter and which is substantially commensurate with the inner perimeter of the first electrical contact member, wherein the tip has a tip perimeter which smaller than the probe contact perimeter, and wherein the contact probe is arranged so that, when the first electrical contact member is received within the recess of the second electrical contact member to establish electrical contact between the first and second electrical contacts, the tip of the contact probe enters the recess of the first electrical contact member before the probe contact surface makes electrical contact with the inner perimeter of the first electrical contact member.

19. The electrical switch of claim 9 further comprising a puffer enclosing an end of the second electrical contact to thereby enclose an end of the second electrical contact member and an end of the contact probe within a puffer volume, the puffer being arranged (a) to compress any gas in the housing around the first electrical contact as the first and second electrical contacts electrically engage one another and (b) to force any gas in the housing toward the first electrical contact as the first and the second electrical contacts are electrically disengaged from one another.

20. The electrical switch of claim 19 wherein the puffer comprises an orifice plate around the second electrical contact member near the end of the second electrical contact member and a puffer cone attached to the orifice plate, the orifice plate and the puffer cone forming the puffer volume, the orifice plate having orifices therein to allow communication between the housing and the puffer volume, and the puffer cone having an opening (a) to allow electrical connection between the first and second electrical contacts and (b) to allow gas in the housing and in the puffer volume to be forced toward the first electrical contact as the first and the second electrical contacts are electrically disengaged from one another.

21. An electrical switch comprising;

a first cylindrical electrical contact member having first and second ends, the first cylindrical electrical contact member having an outer perimeter and the first end of the first cylindrical electrical member having an inner perimeter defining a recess;

a second cylindrical electrical contact member having first and second ends, the second cylindrical electrical contact member having an outer perimeter and the first end of the second cylindrical electrical contact member having an inner perimeter defining a recess;

a contact probe secured to the first end of the second cylindrical electrical contact member within the recess of the second cylindrical electrical contact member, wherein the contact probe has a probe perimeter, wherein the second cylindrical electrical contact member and the contact probe are arranged so that the inner perimeter of the second cylindrical electrical contact member is substantially commensurate with the outer perimeter of the first cylindrical electrical contact member, and wherein the probe perimeter of the contact probe is substantially commensurate with the inner perimeter of the first cylindrical electrical contact member; and, operating means for operating the first cylindrical electrical contact member, the second cylindrical electrical contact member, and the contact probe into electrical contact with one another so that the probe perimeter of the contact probe is an electrical contact with the inner perimeter of the first cylindrical electrical contact member and so that the outer perimeter of the first cylindrical electrical contact member is in electrical contact with the inner perimeter of the second cylindrical electrical contact member.

22. The electrical switch of claim 21 wherein the contact probe comprises at least a tip and a probe contact surface, wherein the probe contact surface has a probe contact perimeter which is substantially equal to the probe perimeter and which is substantially commensurate with the inner perimeter of the first cylindrical electrical contact member, wherein the tip of the contact probe has a tip perimeter which is smaller than the probe contact perimeter, and wherein the contact probe is arranged so that, when the first end of the first cylindrical electrical contact member is received within the recess of the first end of the second cylindrical electrical contact member to establish electrical contact therebetween, the tip of the contact probe enters the recess of the first end of the first cylindrical electrical contact member before the probe contact surface makes electrical contact with the inner perimeter of the first cylindrical electrical contact member.

23. The electrical switch of claim 22 wherein the first cylindrical electrical contact member is slotted to provide at least two flexible contact fingers.

24. The electrical switch of claim 23 wherein the second cylindrical electrical contact member is slotted to provide at least two flexible contact fingers.

25. The electrical switch of claim 24 further comprising a spring member arranged to dampen bouncing and increase contact pressure of the at last two flexible contact fingers of the second cylindrical electrical contact member.

* * * * *